US006446593B1

(12) United States Patent
Suganuma

(10) Patent No.: US 6,446,593 B1
(45) Date of Patent: Sep. 10, 2002

(54) ELECTRICAL SYSTEM FOR MARINE OUTBOARD DRIVE

(75) Inventor: Yasuo Suganuma, Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/694,080

(22) Filed: Oct. 19, 2000

(30) Foreign Application Priority Data

Oct. 19, 1999 (JP) ..... 11-296752

(51) Int. Cl.[7] ..... F02B 17/00
(52) U.S. Cl. ..... 123/198 D; 123/479; 123/630
(58) Field of Search ..... 123/198 D, 479, 123/630, 179.3

(56) References Cited

U.S. PATENT DOCUMENTS 3,996,915 A * 12/1976 Demetrescu ..... 123/486
4,040,395 A * 8/1977 Demetrescu ..... 123/486
4,911,123 A * 3/1990 Ellicott ..... 123/487
4,955,340 A * 9/1990 Elliott ..... 123/487
5,203,292 A 4/1993 Motose
5,207,186 A 5/1993 Okita
5,685,802 A 11/1997 Kanno
5,706,783 A 1/1998 Sawada
5,809,974 A 9/1998 Osakabe
6,032,640 A * 3/2000 Evans ..... 123/486

* cited by examiner

*Primary Examiner*—Noah P. Kamen
*Assistant Examiner*—Jason Benton
(74) *Attorney, Agent, or Firm*—Knobbe, Martens, Olson & Bear, LLP

(57) ABSTRACT

An electrical system for a marine outboard drive includes an improved construction. The outboard drive includes an engine. The engine has a combustion chamber, a fuel supply unit arranged to supply fuel to the combustion chamber, and an igniting unit arranged to fire the fuel in the combustion chamber. The electrical system includes a power source arranged to supply electricity to the fuel supply unit and the igniting unit. The electrical system includes a first control device and a second control device. The first control device is arranged to control the fuel supply unit and the igniting unit while the second control device is arranged to watch the supply of electricity. The second control device is physically separated from the first control device.

28 Claims, 7 Drawing Sheets

ELECTRICAL SYSTEM FOR MARINE OUTBOARD DRIVE

PRIORITY INFORMATION

This invention is based on and claims priority to Japanese Patent Application No. Hei 11-296752, filed Oct. 19, 1999, the entire contents of which is hereby expressly incorporated by reference.

BACKGROUND OF THE INVENTION

1. Field of the Invention

This invention relates to electrical systems for a marine drives, and more particularly to control arrangements of electrical systems and trim systems for marine drives.

2. Description of Related Art

A typical marine outboard drive such as an outboard motor has an internal combustion engine atop a drive unit of the motor. The engine usually drives a propulsion device such as a propeller which is rotatably affixed at the bottom of the drive unit and is placed in a submerged position so as to propel the associated watercraft. The engine burns air/fuel charges in at least one combustion chamber to reciprocate a piston. The piston then rotates a crankshaft connected thereto. Typically, the engine includes an ignition system for intermittently firing the air/fuel charges. The crankshaft drives a driveshaft The driveshaft is coupled to a propeller shaft, with which the propeller rotates. The output of the engine thus powers the propulsion device.

In all fields of engine design, there is increasing emphasis on obtaining high performance in output. This trend has resulted in employing multiple cylinders, such as six cylinders arranged in V-configuration. Increasing the number of cylinders, however, makes ignition control, i.e., typically timing control, more complicated. Moreover, in order to enhance and maintain good performance of the engine, the ignition timing is desirably advanced or delayed in response to various engine running conditions. This further complicates ignition control.

In addition, the engine is occasionally furnished with a fuel injection system configured to obtain more effective emission control, better fuel economy and, at the same time, continued high or higher power output. The fuel injection system can include fuel injectors that spray fuel directly or indirectly into combustion chambers of the engine. Injection timing and duration are fairly important factors that often are tightly controlled.

More recently developed engines thus employ an electronic control unit (ECU) that controls at least the ignition fining of the ignition system, the injection timing and the injection duration of the fuel injection system. An electrical power source supplies power to a number of electrical components and accessories as well as the ignition system and the fuel injection system. The current and voltage are usually controlled by the ECU. The power control, however, generates heat in the ECU and can disrupt the ignition timing, injection tuning and duration controls.

A need therefore exists for an improved electrical system for an internal combustion engine that has reduced deleterious effects upon at least the ignition timing control. If the engine has a fuel injection system, then the electrical system preferably also has reduced effects upon the injection timing and duration controls.

The multiple cylinder engine, on the other hand, inevitably has a large size. In addition to this large size, the engine carries a number of engine related components, including the foregoing electrical components around an outer surface thereof, and thus the overall size of the outboard motor is greatly increased. For instance, a starter motor is mounted on a surface of the engine. The fuel injection system further includes a low-pressure fuel pump, a high-pressure fuel pump and a vapor separator that also are mounted on engine sides. These components are somewhat cumbersome and increase of the overall size of the outboard motor.

The engine usually is enclosed within a protective cowling. For many reasons (i.e., reduced air drag, ease of storing, portability), the protective cowling desirably has a reduced size. A space defined between the engine and the inner surface of the cowling, in which space the above-mentioned components are positioned, should be very compactly arranged.

Another need thus exists for an improved electrical system for a marine outboard drive that is compactly configured so as to be placed at any position in a space defined between an engine and an inner surface of a protective cowling.

SUMMARY OF INVENTION

In accordance with one aspect of the present invention, an electrical system for an internal combustion engine is provided. The engine includes a combustion chamber, a fuel supply unit arranged to supply fuel to the combustion chamber, and an igniting unit arranged to fire the fuel in the combustion chamber. The electrical system comprises a power source arranged to supply electricity to the fuel supply unit and the igniting unit. A first control device is arranged to control the fuel supply unit and the igniting unit. A second control device is arranged to detect abnormalities in the supply of electricity. The second control device is physically separated from the first control device.

In accordance with another aspect of the present invention, an internal combustion engine comprises a cylinder block defining a cylinder bore. A piston reciprocates within the cylinder bore. A cylinder head member closes one end of the cylinder bore and, together with the cylinder bore and the piston, defines a combustion chamber. A fuel injector is arranged to spray fuel into the combustion chamber. A spark plug fires the fuel in the combustion chamber. A spark former is arranged to form a spark at the spark plug. Both the fuel injector and the spark former are electrically operable. A first control unit is arranged to control each operation of the fuel injector and the spark former. A second control unit is arranged to watch each electrical power condition of the fuel injector and the spark former. The first and second control units are physically separated from each other.

In accordance with a further aspect of the present invention, a marine outboard drive is provided. The marine outboard drive is powered by an internal combustion engine having at least an ignition system. The marine outboard drive comprises a drive unit. A bracket assembly is adapted to be mounted on an associated watercraft. The bracket assembly supports the drive unit for pivotal movement about a tilt axis extending generally horizontally. An actuator is arranged to selectively raise and lower the drive unit relative to the bracket assembly. An electrically operable powering device is arranged to power the actuator. A first control unit is arranged to control the ignition system. A second control system is arranged to control the powering device. The first and second control units are defined separately from each other.

Further aspects, features and advantages of this invention will become apparent from the detailed description of the preferred embodiments which follow.

BRIEF DESCRIPTION OF THE DRAWINGS

These and other features, aspects and advantages of the present invention will now be described with reference to the drawings of several preferred embodiments which are intended to illustrate and not to limit the invention The drawings comprise seven figures.

DETAILED DESCRIPTION OF THE PREFERRED EMBODIMENTS OF THE INVENTION

Figure 1:
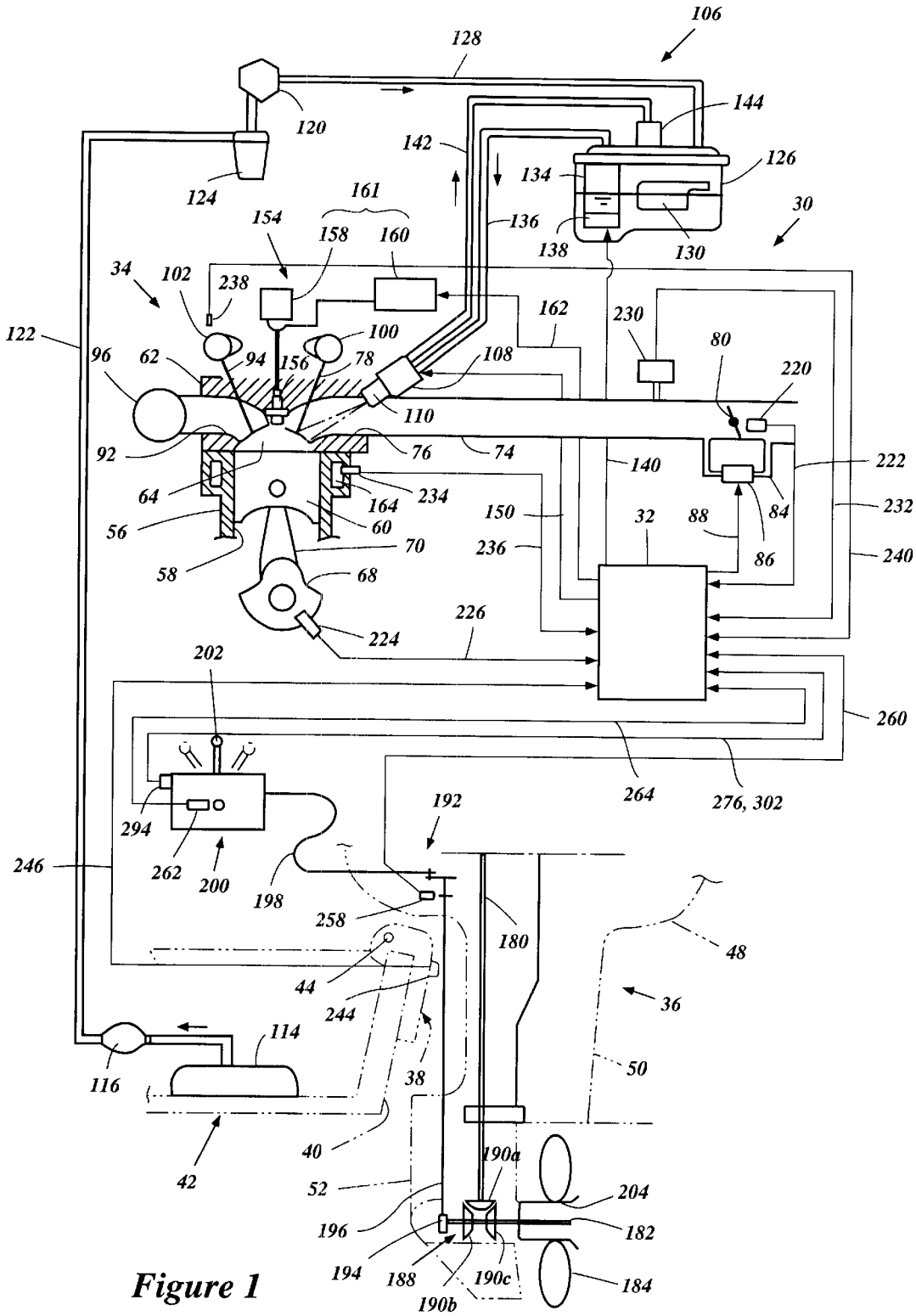
FIG. 1 is a schematic view of an outboard motor that has an electrical system configured in accordance with a preferred embodiment of the present invention. A portion of an engine, including an air intake system, a fuel injection system and an ignition system is generally shown in the upper portion of the figure. A portion of the outboard motor, including a transmission and a shift device of the transmission, and an associated watercraft are shown in the lower portion of the figure. The electrical system links together the two portions of the figure. The outboard motor and the associated watercraft are partially illustrated in phantom.

With reference primarily to FIG. 1 and additionally to FIGS. 2 and 3, an overall construction of an outboard motor 30, which includes an electrical system 32 configured in accordance with a presently preferred arrangement of the present invention, will be described. The outboard motor 30 includes an internal combustion engine 34. Although the present invention is shown in the context of an engine for an outboard motor, various aspects and features of the present invention also can be employed with engines used in other types of marine drives (e.g., a stern drives and in-board/outboard drives) and also, for example, with engines used in land vehicles.

In the illustrated arrangement the outboard motor 30 comprises a drive unit 36 and a bracket assembly 38. The bracket assembly 38 supports the drive unit 36 on a transom 40 of an associated watercraft 42 so as to place a marine propulsion device in a submerged position with the watercraft 42 resting on the surface of a body of water. Although schematically shown in FIG. 1, the bracket assembly 38 actually comprises a swivel bracket, a clamping bracket, a steering shaft and a pivot pin 44 about which the outboard motor can be tilted or trimmed.

The steering shaft typically extends through the swivel bracket and is affixed to the drive unit 36. The steering shaft is pivotally journaled for steering movement about a generally vertically extending steering axis within the swivel bracket. The clamping bracket often includes a pair of bracket arms spaced apart from each other and affixed to the watercraft transom 40. The pivot pin 44 completes a binge coupling between the swivel bracket and the clamping bracket The pivot pin 44 tends through the bracket arms so that the clamping bracket supports the swivel bracket for pivotal movement about a generally horizontally extending tilt axis defined by the pivot pin 44.

As used through this description, the terms "front," forward" and "forwardly" mean at or to the side where the bracket assembly 38 is located, and the terms "rear," "rearward," "rearwardly" and "reverse" mean at or to the opposite side of the front side, unless indicated otherwise or otherwise readily apparent from the context of use.

A hydraulic tilt and trim adjustment system preferably is provided between the swivel bracket and the clamping bracket to raise up or lower down the swivel bracket and the drive unit 36 relative to the clamping bracket. The tilt system preferably includes an actuator having a cylinder housing, a piston and a piston rod. The cylinder housing can define an inner cavity in which The piston reciprocates and can be pivotally affixed to the swivel bracket or the clamping bracket. The piston divides a pair of chambers within the cavity defined by the cylinder housing. A piston rod extends from the piston and beyond one end of the cavity. The piston rod preferably is pivotally affixed to the other one of the swivel bracket and the clamping bracket.

The tilt system farther includes a powering assembly for selectively supplying working fluid to at least one of the chambers. More specifically, the preferred powering assembly includes a reversible hydraulic pump and a reversible electric tilt motor 46 (FIG. 2). The tilt motor 46 drives the hydraulic pump in either direction so tat the hydraulic pump supplies the working fluid to either one of the chambers. The piston rod is thus pushed or pulled. With this movement of the piston rod, the drive unit is raised or lowered relative to the watercraft transom 40.

The drive unit 36 moves within a trim adjustment range and a tilt range. The tilt range provides angular positions of the drive unit 36 larger than angular positions which the trim adjustment range provides. A propulsion device, which will be described later, is in a submerged position when the drive unit 36 is in the ti adjustment position. The trim range movement can trim the propulsion device relative to the watercraft 42 while the propulsion device is in the submerged position. When the drive unit 36 is in the tilt range, the propulsion device is generally out of water. The tilt range is therefore typically used for mooring the watercraft 42 or servicing a lower portion of the motor.

The illustrated drive unit 36 generally includes a power head 48, a driveshaft housing 50 and a lower unit 52. The power head 48 is disposed atop the drive unit 34 and includes the engine 34 and a protective cowling 54 (FIG. 3). The protective cowling defines a generally closed cavity in which the engine 34 is disposed. While not shown, the protective cowling 54 preferably comprises a top cowling member and a bottom cowling member. The top cowling member preferably is detachably affixed to the bottom cowling member so that the operator can access the engine for maintenance or for other purposes.

The engine 34 preferably operates on a four-cycle principle and powers the propulsion deice. The illustrated engine 34 comprises a cylinder block 56. The presently preferred cylinder block 56 defines six cylinder bores 58. Three cylinder bores 58 extend generally horizontally and are vertically spaced from one another to form a first bank. The other three cylinder bores 58 also extend generally horizontally and are vertically spaced from one another to form a second bank. Both of the banks preferably intersect at an angle so that the engine 34 is generally V-shaped.

A piston 60 can reciprocate in each cylinder bore 58. A pair of cylinder head assemblies 62 are affixed to the cylinder block 56 to enclose the pair of cylinder banks. The cylinder head assemblies, in combination with the cylinder bores and the pistons, define six combustion chambers 64. The other end of the cylinder block 56 preferably is closed with a crankcase member that at least partially defines a crankcase chamber. A crankshaft 68 extends generally vertically through the crankcase chamber. The craftshaft 68 preferably is connected to the pistons 60 by connecting rods 70 and is rotated by the reciprocal movement of the pistons 60. Preferably, the crankcase member is located at the most forward position with the cylinder block 56 and the cylinder head assembly 62 extending rearward from the crankcase member 66, one after another.

The engine 34 includes an air induction system for introducing air to the combustion chambers 64. The air induction system preferably includes a plenum chamber, at least one air intake passage 74 and associated intake ports 76 that are formed in the cylinder block. The air intake passages 74 and the intake ports 76 are associated with the respective combustion chambers 64. The intake ports 76 are defined in the cylinder head assembly 62 and are repeatedly opened and closed by intake valves 78. When the intake ports 76 are opened, the air intake passages 74 communicate with the associated combustion chambers 64.

The protective cowling 54 has an air intake opening trough which the ambient air is introduced into the closed cavity. The air in this cavity is then introduced into the air intake passages 74 through the plenum chamber. Because the intake passages 74 communicate with the combustion chambers 64, the air can enter these combustion chambers 64 through a measurement mechanism.

The measurement mechanism preferably includes a throttle valve 80 that is disposed within each air intake passage 74 downstream the plenum chamber The throttle valve 80 has a valve shaft extending generally vertically and is journaled for pivotal movement. Accordingly, a certain amount of air is admitted into the passage 74 in proportion to an opening degree of the throttle valves 80. The valve shaft is operable by the watercraft operator through a throttle linkage. Under a normal running condition, the larger the amount of the air, the higher the speed of the engine operation.

When the throttle valves 80 are in a closed position, the air flow through the intake passages 74 is greatly reduced. In order to maintain idle speed, however, a small amount of air is still necessary. Preferably, au auxiliary passage 84 is coupled with one of the intake passages 74 so as to bypass the throttle valve 80. The auxiliary passage 84 can have an idle air adjustment valve 86. An opening degree of the adjustment valve 86 is electrically controlled by the electrical system 32 through a control signal line 88. The electrical system 32 will be described in great detail later.

The engine 34 also preferably includes an exhaust system for discharging burnt charges or exhaust gases to a location outside of the outboard motor 30 from the combustion chambers 64. Exhaust ports 92 are defied in the cylinder head assembly 62 and are repeatedly opened and closed by exhaust valves 94. When the exhaust ports 92 are opened, the combustion chambers 64 communicate with an exhaust manifold 96 which collects the exhaust gases and directs them downstream. The exhaust gases, in major part, are discharged to the body of water surrounding the outboard motor 30 through exhaust passages formed in the driveshaft housing 50 and the lower unit 52.

An intake camshaft 100 and an exhaust camshaft 102 are journaled for rotation and extend generally vertically in the cylinder head assembly 62. The intake camshaft 100 actuates the intake valves 78 while the exhaust camshaft 102 actuates the exhaust valves 94. The camshafts 100, 102 have cam lobes thereon to push the respective valves 78, 94. The associated ports 76, 92 are thus opened and closed repeatedly.

Preferably, the craft 68 drives the camshafts 100 102. Each camshaft 100, 102 has a sprocket, while the crankshaft 68 also has a sprocket. A timing belt or chain is wound around the respective sprockets. The crankshaft 68 therefore drives the camshafts 100, 102.

The illustrated engine 34 farther includes a fuel injection system 106. The fuel injection system 106 preferably employs six fuel injector 108 with one fuel injector allotted for each of the respective combustion chamber 64. Each fuel injector 108 has an injection nozzle 110 that is exposed to the intake port 76. The injection nozzle 110 preferably is opened and closed by an electromagnetic unit which is slideable within an injection body. The electromagnetic unit has a solenoid coil controlled by electrical signals. When the nozzle 110 is opened, pressurized fuel is released from the fuel supply lines. In the illustrated embodiment, the injection nozzle 110 is directed toward the, combustion chambers 64. The fuel injectors 108 spray the fuel into the intake ports 76 dug an open timing of the ports 76. The sprayed fuel thus enters the combustion chambers 64 with air that passes through the intake passages 74. Of course, the present invention also can be used with direct injected engines, in which the fuel is directly injected into the engine. Also, some features of the present invention can be used with carbureted engines as well.

The fuel injection system 106 includes a fuel supply tank 114 that preferably is placed in the hull of the associated watercraft 42. Fuel is drawn from the fuel tank 114 by a first low pressure fuel pump 116 and a second low pressure pump 120 through a first fuel supply conduit 122. The first low pressure pump 116 is a manually operated pump. The second low pressure pump 120 is a diaphragm tpe pump that can be operated by, for example, one of the intake and exhaust camshafts 100, 102. In this instance, the second low pressure pump 120 is mounted on the cylinder head assembly 62. A quick disconnect coupling is provided in the first conduit 122. Also a fuel filter 124 is positioned in the conduit 122 at an appropriate location.

From the low pressure pump 120, the fuel is supplied to a vapor separator 126 through a second fuel supply conduit 128. In the illustrated embodiment, the vapor separator 126 is mounted on the main air intake passage 74. At the vapor separator end of the conduit 128, there is provided a float valve that is operated by a float 130 so as to maintain a uniform level of the fuel contained in the vapor separator 126. A high pressure fuel pump 134 is provided in the vapor separator 126 and pressurizes the fuel that is delivered to the fuel injectors 108 though a delivery conduit 136. A fuel rail that defines a portion of the delivery conduit 136 supports the fuel injectors 108. The high pressure fuel pump 134 in the illustrated embodiment preferably is a positive displacement pump. The construction of the pump thus generally inhibits fuel flow from its upstream side back into the vapor separator 126 when the pump 134 is not running. Although not illustrated, a back-flow prevention device (e.g., a check valve) also can be used to prevent a flow of fuel from the delivery conduit 136 back into the vapor separator 126 when the pump is off. This later approach can be used with a fuel pup Sat employs a rotary impeller to inhibit a drop in pressure within the delivery conduit 136 when the pump is intermittently stopped.

The high pressure fuel pump 134 is driven by a fuel pump drive motor 138 which in the illustrated embodiment is unified with the pump 134 at its bottom portion. The fuel pump drive motor 138 is inevitably positioned in the vapor separator 126. In the illustrated embodiment the fuel pump drive motor 13 8 is powered by the electrical system 32 through a power supply line 140.

A fuel return conduit 142 also is provided between the fuel injectors 108 and the vapor separator 126. Excess fuel that is not injected by the injector 108 returns to the vapor separator 126 through the return conduit 142. A pressure regulator 144 is mounted on the vapor separator 126 and at the end of the return conduit 142 to limit the pressure that is delivered to the fuel injectors 108 by dumping the fuel back to the vapor separator 126.

A desired amount of the fuel is sprayed into the intake ports 76 through the injection nozzles 110 at a selected timing for a selected duration. The injection timing and duration preferably are controlled by the electrical system 32 trough a control signal line 150. That is, the solenoid coil is supplied with electric power at the selected timing and for the selected duration. Because the pressure regulator 144 strictly controls the fuel pressure, the duration can be used to determine a selected amount of fuel that will be supplied to the engine 34.

The engine 34 further includes an ignition or firing system 154. Each combustion chamber 64 is provided with a spark plug 156. The spark plug 156 is exposed into the associated combustion chamber 64 and ignites an air/fuel charge at a selected ignition timing. The ignition system 154 preferably has an ignition coil 158 and an igniter 160 which are connected to the electrical system 32 through a control signal line 162 so that an ignition timing also can be controlled by the electrical system 32. In order to enhance and maintain good performance of the engine 34, the ignition timing can be advanced or delayed in response to various engine running conditions.

The ignition coil 158 preferably is a combination of a primary coil element and a secondary coil element that are wound around a common core. Desirably, the secondary coil element is connected to the park plugs 156 while the primary coil element is connected to the ignitor 160. Also, the primary coil element is coupled with a power source, which will be described later, and electrical current flows therethrough. The ignitor 160 abruptly cuts off the current flow in response to an ignition timing control signal and then a high voltage current flow occurs in the secondary coil element. The high voltage current flow forms a spark at each spark plug 156. In the illustrated embodiment, the ignition coil 158 and the ignitor 160 define a spark former 161.

The engine 34 accumulates heat in, for example, the cylinder block 56 and the cylinder head assembly 62. A water jacket 164 is provided for cooling at least these portions 56, 62. Cooling water is introduced from the body of water surrounding the outboard motor 30 and is then discharged there. That is, the engine 34 employs an open loop type cooling system.

Figure 2:
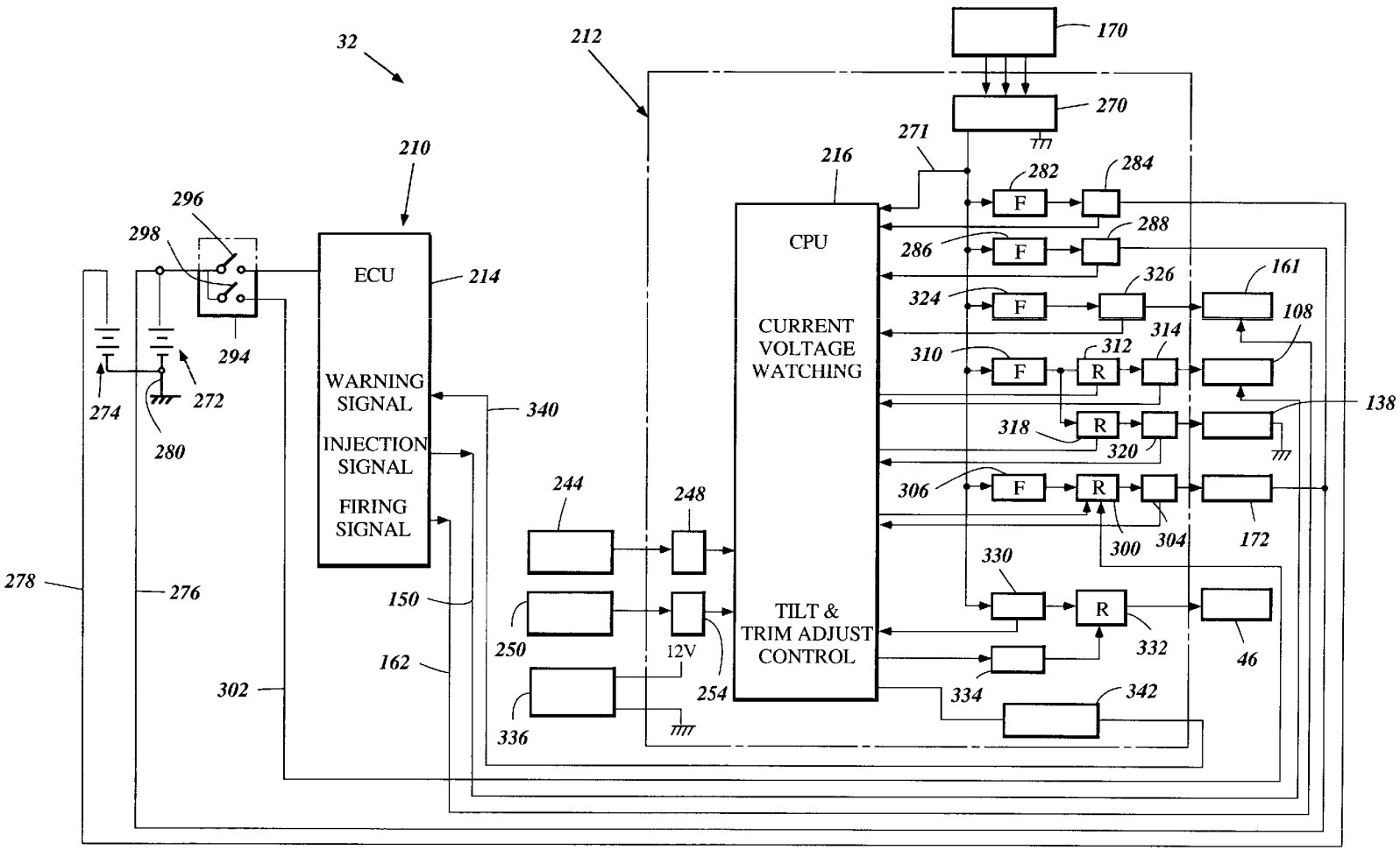
FIG. 2 is a diagramatical view of the electrical system.
Figure 3:
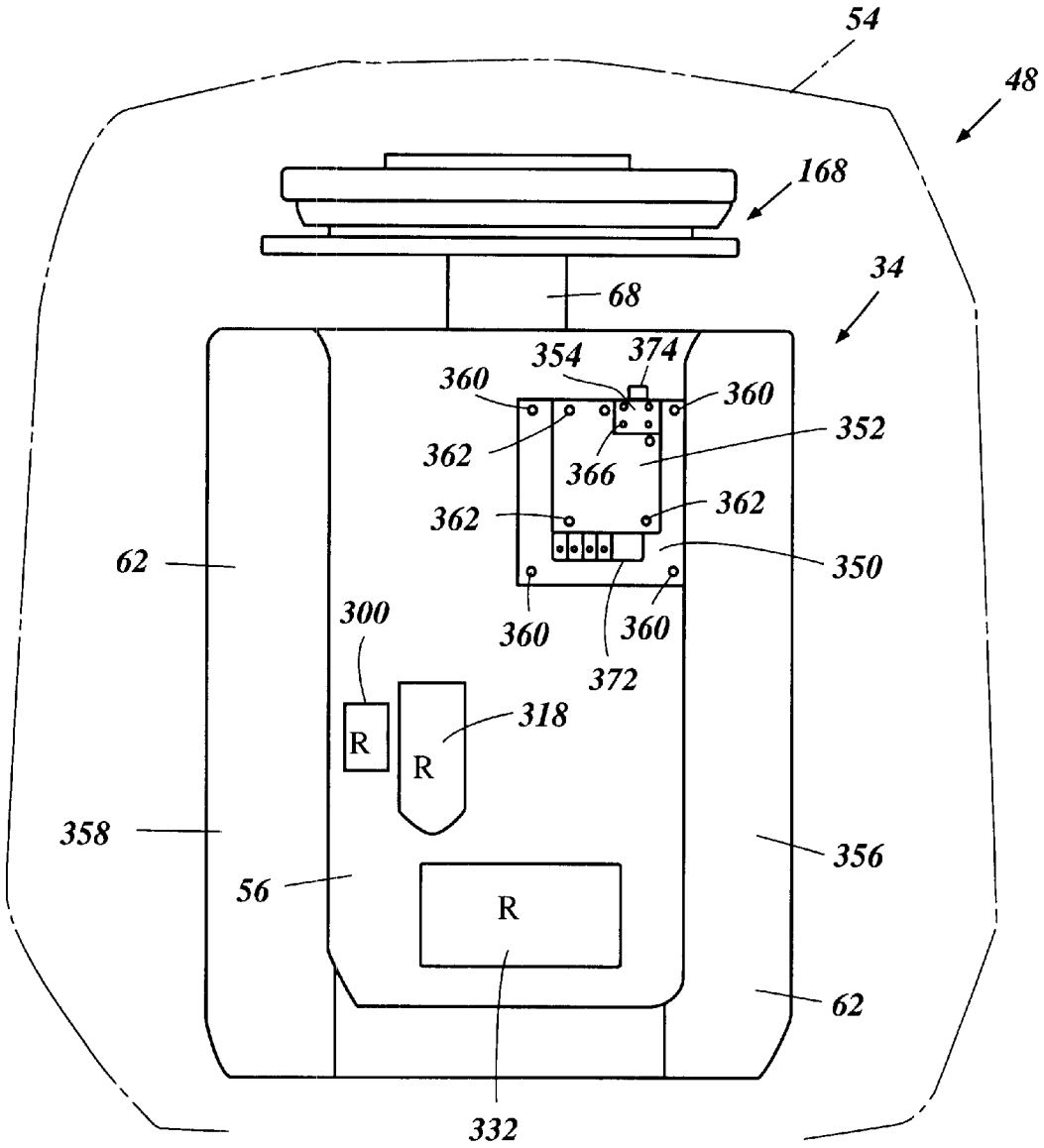
FIG. 3 is a schematic front view of a power head of the outboard motor A protective cowling is shown in phantom.

As seen in FIG. 3, a flywheel assembly 168 is affixed atop the crankshaft 68. The flywheel assembly 168 includes an AC generator or flywheel magneto 170 (FIG. 2) that supplies electric power to electrical components including the fuel injection system 106 and the firing system 154. A starter motor 172 (FIG. 2) is provided for driving the crankshaft 68 to start the engine 34. The starter motor 172 has a gear portion that meshes with a ring gear of the flywheel assembly 168. When the engine starts, the Starter motor 172 drives the crankshaft 68 through the gear connection. Once the engine 34 starts, however, the starter motor 172 ceases operation. The starter motor 172 and its operation will be described more in detail shortly.

With reference now to the lower portion of FIG. 1, the driveshaft housing 50 depends from the power head 48 and supports a driveshaft 180 which is driven by the crankshaft 68. The driveshaft 180 extends generally vertically through the driveshaft housing 50. The driveshaft housing 50 also defines internal passages which form portions of the exhaust system.

The lower unit 52 depends from the driveshaft housing 50 and supports propulsion shaft 182 which is driven by the driveshaft 180. The propulsion shaft 182 extends generally horizontally through the lower unit 48. In the illustrated embodiment, the propulsion device is a propeller 184 that is affixed to an outer end of the propulsion shaft 182 and is driven thereby. The propulsion device, however, can take the form of a dual, a counter-rotating system, a hydrodynamic jet, or any of a number of other suitable propulsion devices.

A transmission 188 is provided between the driveshaft 180 and the propulsion shaft 182. The transmission 188 couples together the two shafts 180, 182 which lie generally normal to each other (i.e., at a 90° shaft angle) with bevel gears 190*a*, 190*b*, 190*c*. The outboard motor 30 has a switchover or clutch mechanism 192 for the transmission 188 to shift rotational directions of the propeller 184 among forward, neutral or reverse.

The switchover mechanism 192 includes a shift cam 194, a shift rod 196 and a shift cable 198. The shift rod 196 extends generally vertically through the driveshaft housing 50 and the lower unit 52. The shift cable 198 extends through the protective cowling 54 and then forwardly to a manipulator 200 which Is located next to a dashboard in the associated watercraft 42. The manipulator 200 has a shift lever 202 which is operable by the watercraft operator.

The lower unit 52 also defines an internal passage that forms a discharge section of the exhaust system. At engine speed above idle, the majority of the exhaust gases are discharged to the body of water surrounding the outboard motor 30 through the internal passage and finally through an outlet passage 204 defined through the hub of the propeller 184.

With primarily reference to FIGS. 2 and 3, but still reference to FIG. 1 also, a detail of the electrical system 32 and a number of sensors associated with the system 32 will now be described. In the illustrated arrangement, the electrical system 32 comprises a first or primary control device 210 and a second or secondary control device 212. Preferably, a single unit 214 , such as an ECU (Electronic Control Unit) for example, defines the first control device 210. The second control device 212 preferably comprises a plurality of members or elements. The base component can be a CPU (Central Processing Unit) 216. Both the ECU 214 and the CPU 216 preferably are formed with LSI (Large Scaled Integrated circuit) and can be produced in a conventional manner.

The first control device 210 (i.e., ECU 214) primarily controls engine operations including operations of the fuel injection system 106 and the ignition system 154. The second control device 212 watches fluctuations in electricity supplied to actuators including the fuel injectors 108 and the spark former 161. If an abnormal change in current and/or voltage is detected, the second control device 212 alerts the first control device 210 of the change. In addition to watching the electricity conditions, the second control device 216 in the illustrated arrangement controls the hydraulic tilt and trim adjustment system. Preferably, the second control device 216 controls the operation of the tilt motor 46 of the tilt system.

The preferred ECU 214 stores a plurality of control maps or equations related to various control routines. In order to determine appropriate control indexes in the maps or to calculate them using equations based upon the control indexes determined in the maps, various sensors are provided for sensing engine conditions and other environmental conditions With reference again to FIG. 1, a throttle valve position sensor 220 is provided adjacent to at least one of the throttle valves 80 to sense an opening degree of the throttle valves 80. A sensed signal is sent to the ECU 214 trough a sensor signal line 222. Of course, the signals can be sent through hard-wired connections, emitter and detector pairs, infrared radiation, radio waves or the like. The type of signal and the type of connection can be varied between sensors or the same type can be used with all sensors.

Associated with the crankshaft 68 is a crankshaft angle position sensor 224 which, when measuring crankshaft angle versus time, outputs a crankshaft rotational speed signal or engine speed signal that is sent to the ECU. 214 through a sensor signal line 226, for example.

An intake air pressure sensor 230 senses air pressure in one of the intake passages 74. The sensed signal is sent to the ECU 214 through a sensor signal line 232, for example. This signal can be used for determining an engine load. A water temperature sensor 234 at the water jacket 164 sends a cooling water temperature signal to the ECU 214 through a sensor signal line 236, for example. This signal represents engine temperature. A cylinder discrimination sensor 238 senses a rotational angle of the exhaust camshaft 102. The sensed signal is transmitted to the ECU 214 through a sensor signal line 240, for example.

As noted above, the second control device 212 controls the hydraulic tilt system. Preferably, the CPU 216 implements this control. A trim sensor 244 is affixed to the clamping bracket to sense an angular position of the swivel bracket relative to the clamping bracket. For example, a non-contact or close switch is used as this sensor. The sensed signal is sent to the CPU 216 through a sensor signal line 246, for example, to a wave shaping circuit or sensor circuit 248. The wave shaping circuit 248 modulates the sensor signal before the signal is supplied to the CPU 216 in the illustrated arrangement. Although not shown in FIG. 1, the foregoing sensor signals preferably also are toed with similar wave shaping circuits before entering the ECU 210.

A tilt limit sensor 250 also can be provided for the hydraulic tilt system so as to prevent the protective cowling 54 from hitting the watercraft 42 when the drive unit 36 is tilted up. For example, a mercury switch can be used as the tilt limit sensor. The mercury switch generally has two contact points that are slightly spaced apart from each other and a mercury drop can move into this location when a base portion inclines. This sensor 250 is affixed to the swivel bracket or the drive unit 36. When the drive unit 36 tilts and then reaches a preset angular position, the mercy drop moves to make an electrical connection between the contact points. The sensor 250 then sends a signal to the CPU 210 through a sensor signal line 252 and a wave shaping circuit 254, in the illustrated arrangement Also, a shift position sensor 258 sends a signal indicating a position of the shift rod 196 (forward, neutral or reverse) to the ECU 214 through a sensor signal line 260. A lever operational speed sensor 262 senses a rotational speed of the shift lever 202 and its signal is sent to the ECU 214 through a sensor signal line 264, for example.

With reference now to FIG. 2, the illustrated second control device 212 includes a power regulator 270 that comprises a rectifier and a current/voltage regulator. The power regulator 270 can be juxtaposed with the CPU 216 in a single container. In the illustrated arrangement, however, these components are physically separated and contained in different containers as described in detail later.

The AC generator 170 preferably is connected to the power regulator 270 so that the AC power generated by the generator 170 is rectified and regulated by the power regulator 270. The rectified and regulated power, i.e., DC power, is supplied to the CPU 216 through a power line 271 in the illustrated arrangement. The DC power also is supplied to a main battery 272 and to an auxiliary battery 274 through power lines 276, 278 in the illustrated arrangement The main battery 272 preferably supplies electricity to the ECU 214 and the starter motor 172, while the auxiliary battery 274 preferably supplies electricity to accessories such as lights, indicators and buzzers. The main and auxiliary batteries 272, 274 can be commonly grounded as shown by the reference numeral 280.

The illustrated power line 276 has a fuse 282 and a voltage detector 284 while the power line 278 preferably has a fuse 286 and a voltage detector 288. The fuses 282, 286 and the voltage detectors 284 can be arranged in series in the respective power lines 276, 278. As is well known, a fuse typically is an alloy piece which melts in the event excess current flows therethrough so as to inhibit the current from flowing further. Both the fuses 282, 286 can be similar to each other. The other fuses which will be described below also can be similar ones. Each voltage detector 284, 288 advantageously emits a detection signal to the CPU 216 if the voltage of the electricity flowing through the respective power lines 276, 278 fluctuates out of a preset range. In other words, the CPU 216 preferably detects whether an abnormal fluctuation of the voltage occurs in the power lines 276, 278 through the voltage detectors 284, 288.

The main battery 272 can be connected to the ECU 214 through a power line 292. A combination switch 294 preferably is provided on the manipulator 200 and between the main battery 272 and the ECU 214. The: illustrated combination switch 294 has a couple of moveable contacts 296, 298 that can contact fixed contacts. The moveable contact 296 and the associated fixed contact are disposed in the power line 292 and together define a main switch that couples the main battery 272 with the ECU 214 in the illustrated arrangement. The DC power of the main battery 272 thus can be supplied to the ECU 214 when the main switch is in the on position.

In the illustrated arrangement, the main battery 272 also is connected to a relay 300 through a starter switch and a control signal line 302. The starter switch preferably is defined by the other moveable contact 298 and the associated fixed contact. The moveable contact 298 can be linked together with the moveable contact 296 and, therefore, can be simultaneously moved with the moveable contact 296. That is, the starter switch preferably is operable together with the main switch. The illustrated relay 300 is connected to the starter motor 174 via a current/voltage detector 304, and is also coupled with the power regulator 270 via a fuse 306. The current/voltage detector 304 is a similar detector to the voltage detector 284, 288, but can detect fluctuations in current additionally.

The starter motor 172 is supplied with a relatively large level of power from the main battery 272 through the power line 276. When the operator turns the starter switch on, the relay 300 is turned on to activate the starter motor 172. As described above, the starter motor 172 drives the crankshaft 68 when the starter motor 172 rotates and the engine 34 starts accordingly. Then, the AC generator 170 begins generating AC power. The AC power can be supplied to the relay 300 and the relay 300 then is turned off. The starter motor 172 thus no longer rotates after the AC power is supplied to the relay 300. The current/voltage detector 304 detects an abnormal condition in current/voltage that is supplied to the starter motor 172 and informs the CPU 216 if an abnormality in the supply occur. The abnormal conditions can include, for example, an excess current flow through the starter motor 172. The excess current flow might be caused if one of the piston(s) 60 seizes or if the camshaft (s) and/or valve(s) 78, 94 stick. In some cases, the excess current flow can be detected due to a short in the starter motor circuit (not shown). If an abnormal condition is detected, the CPU 216 shuts down the starter motor operation.

In the illustrated arrangement, the ECU 214 controls the fuel injectors 108 through the control signal line 150. Power is supplied to the fuel injectors 108 from the power regulator 270 via a fuse 310, a relay 312 and a current/voltage detector 314 in the illustrated arrangement. The CPU 216 preferably has a control line connected to the relay 312 to tum the relay 312 on when the CPU 216 is powered through the power line 271, i.e., when the AC generator 170 starts generating power. The relay 312 thus allows power to be supplied to the fuel injectors 108 as soon as the engine 34 starts. Power thus supplied can activate the solenoid coil in the fuel injectors 108 to open the injector nozzles 110 The fuel injectors 138 spray fuel to the intake ports 76 in accordance with the control signal that is sent from the ECU 214 through the control signal line 150. Like the current/voltage detector 304, the current/voltage detector 314 detects an abnormal fluctuation in current/voltage and informs the CPU 216 of the occurrence of the abnormal condition.

A power line to the fuel injectors 108 can be split between the fuse 310 and the relay 312. The branch power line can be connected to the fuel pump drive motor 133 via a relay 318 and a current/voltage detector 320. Preferably, no control line is connected to the drive motor 138 from the ECU 210. The relay 318 can be constructed and arranged in a manner similar to the relay 312, while the current/voltage detector 320 can be constructed and arranged in a manner similar to the current/voltage detector 314. Preferably, the drive motor 138 starts operating when tie engine 34 starts because the relay 318 turns on with the engine starts. The current/voltage detector 320 can detect an abnormal fluctuation in current/voltage and can informs the CPU 216 of any abnormalities that are detected.

The ECU 214 m this arrangement also controls the spark former 161 through the control signal line 162. The current flowing through the ignition coil 158 can be supplied from the power regulator 270 via a fuse 324 and a current/voltage detector 326. Preferably, no relay is provided between the power regulator 270 and the Ignition coil 158. That is, the spark former 161 advantageously is immediately operable when the AC generator 170 starts rotation. The spark former 161, and in some arrangements, the ignition coil 158, preferably cuts off current from the power regulator 270 when the ECU 214 gives an ignition signal to the ignitor 160 through the control signal line 162. When signaled, a spark can be produced between the electrodes of each spark plug 156. The spark fires the air/fuel charge in the associated combustion chamber 64. Like the current/voltage detectors 304, 314, the current/voltage detector 326 can detect an abnormal fluctuation in current/voltage and can inform the CPU 216 of any detected abnormalities.

In the illustrated arrangement, the CPU 216 controls the hydraulic tilt and trim adjustment system via the tilt motor 46. The tilt motor 46 can be powered by the power regulator 270 via a current detector 330 and a relay 332. In the illustrated arrangement, the relay 332 is a combined type and has a tilt up relay element and a tilt down relay element that are combined together. Two relays which are physically separated from each other can be used in place of the relay 332 in some configurations. A driver circuit 334 selectively switches the relay 332 to a tilt up, tilt down or neutral position in accordance with the operator's selection. A tilt switch 336, which is a three position switch, is provided at the second control device 330 to activate the driver circuit 334 into one of these positions. The tilt switch 336 preferably is powered by either the main battery 272 or the auxiliary battery 274 and can be grounded to the second control device 212.

When the tilt switch 336 is operated to the tilt up position, the relay 332 advantageously allows the cement from the power regulator 270 to flow into the tilt motor 46 in one direction. The tilt motor 46 drives the hydraulic pump to tilt up the drive unit 36 accordingly. Meanwhile, when the tilt switch 336 is operated to the tilt down position, the relay 332 advantageously allows the current from the power regulator 270 to flow into the tilt motor 46 in the other direction. The tilt motor 46 thus drives the hydraulic pump to tilt down the drive unit 36. When the tilt switch 336 is operated to the neutral position, the relay 332 cuts off the current from being supplied to the tilt motor 46 and hence the tilt motor 46 stops driving the hydraulic pump.

If excess current flows through the current detector 330, the current detector 330 informs the CPU 216 of the condition. The CPU 216 then controls the driver circuit 334 through the relay 332 to reduce or stop the curt flow, A warning signal line 340, which includes a warning output circuit 342, preferably is provided between the CPU 216 and the ECU 214. The warning output circuit 342 sends a warning signal to the ECU 210 from the CPU 216. The CPU 216 generates the warning signal when the abnormal current and/or voltage is detected by at least one of the voltage detectors 284, 288, the current/voltage detectors 304, 314, 320 and the current detector 330. The ECU 214 then starts controlling engine operations under an emergency mode. The emergency mode includes, for example, a slowdown control of the engine speed. The ECU 214 further operates a power source check system that searches for causes of the abnormal condition.

In the illustrated arrangement, semiconductor or non-contact type relays are used as the relays 300, 312, 318, 332, mechanical or contact type relays are also applicable though.

Figure 4:
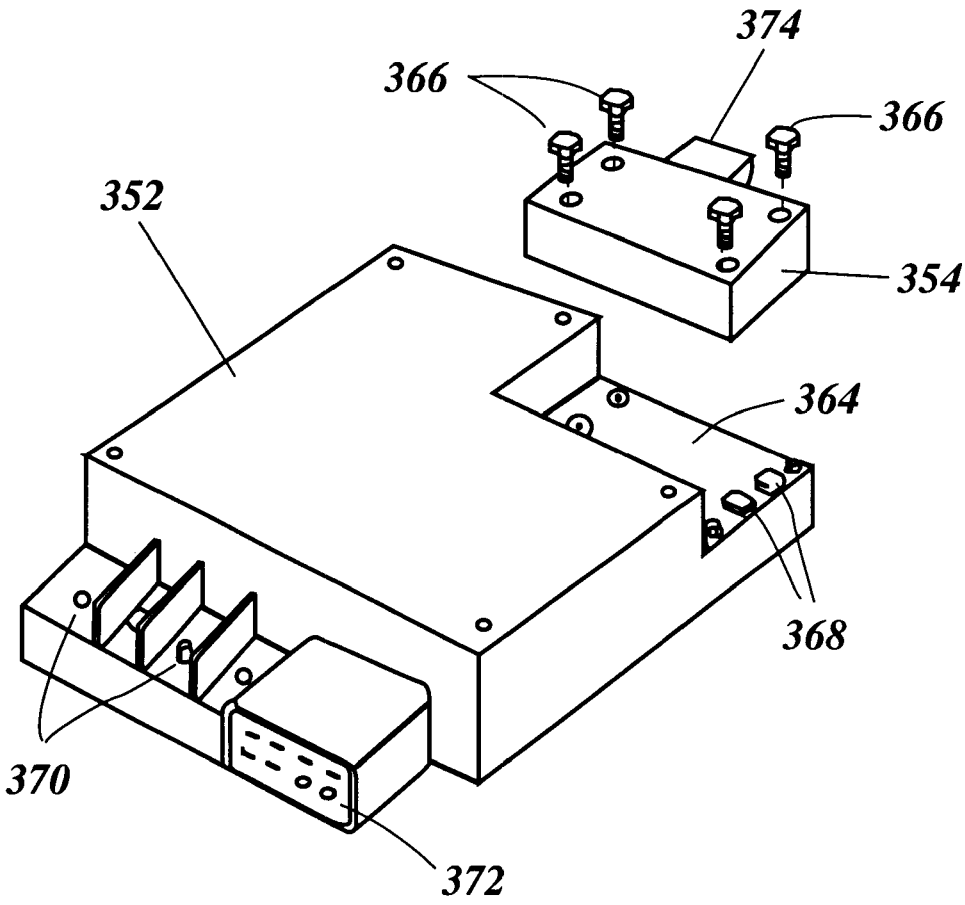
FIG. 4 is a perspective view showing an arrangement of first, second and third boxes.

With reference now to FIGS. 3 and 4, presently preferred constructions and arrangements of the first and second control devices 210,212 will be described below.

The first control device 210 preferably is contained in a first closed or substantially closed box or container 350, while the second control device 212 is generally contained in a second closed or substantially closed box or container 352 which is physically separated from the first box 350. As noted above, the power regulator 270 preferably is further separated and contained in a third closed box or container 354. The relays 300, 312, 318, 332 can be arranged in the second box 352. In the illustrated embodiment, however, the relays 300, 318, 332 are placed outside of the box 352. The boxes 350, 352 preferably are water-tightly sealed. In some arrangements, the coupler portions of the boxes can be watertightly sealed as well.

In the illustrated arrangement, the first box 350 is located between the V banks 356, 358 and is affixed to a front surface of the cylinder block 56 by bolts 360. The second box 352 preferably is mounted on the first box 350 and is affixed by bolts 362. As seen in FIG. 4, the second box can have a recessed portion 364 at one end corner and the third box 354 can be positioned in this recessed portion 364 and can be affixed to the second box 352 by bolts 366. Both the second and third boxes 352, 354 advantageously have connectors 368 to make electrical connections therebetween.

The second box 352 also preferably has connectors 370 and a coupler 372. The main and auxiliary batteries 272, 274, the tilt motor 46 and the starter motor 172 can be connected to the second box 352 through the connectors 370. The fuel injection system 106 and the ignition system 154 also can be connected to the second box 352 through the coupler 372. The trim sensor 244, the tilt limit sensor 250 and the tilt switch 336 also preferably are coupled with the second box 352 through appropriate connectors or couplers that are not shown. The third box 354, in turn, can have a coupler 374 that is connected to the AC generator 170.

Although not shown in FIG. 4, the fuses 282, 286, 306, 310, 324 preferably are detachably enclosed within the second box 352. This configuration eases access to replace blow fuses when necessary. For example, recesses for the fuses 282, 286, 306, 310, 324 can be defined at the upper surface of the second box 352. Each fuse 282, 286, 306, 310, 324 is positioned in the respective recesses. The recesses can be closed with an appropriate closure member that can be opened and closed by, for example, a binge mechanism.

Because the second box 352 and the third box 354 contain the units, circuits and/or elements that manage the relatively large power, heat is produced and may accumulate therein. This heat preferably is not be transferred to the ECU 214. In the illustrated arrangement, the ECU 214 is disposed within the first box 350, which is separated from the second and third boxes 354. Thus, the heat is not directly transferred to the ECU 214 in the first box 350. However, it is desirable to insert a heat insulator between the first and second boxes 350, 352 to isolate them for completely blocking the heat transfer. It is preferable to additionally insert other heat insulators between the outer surface of the engine 34 and the first box 350 and/or between the second and third boxes 352, 354. The second and third boxes 352, 354 can be provided with cooling fins to increase heat transfer away from the boxes 352, 353. Air moving within the enclosed engine compartment thus can absorb some of the beat from the boxes 350, 352, 354 and the fins, if provided.

Figure 5:
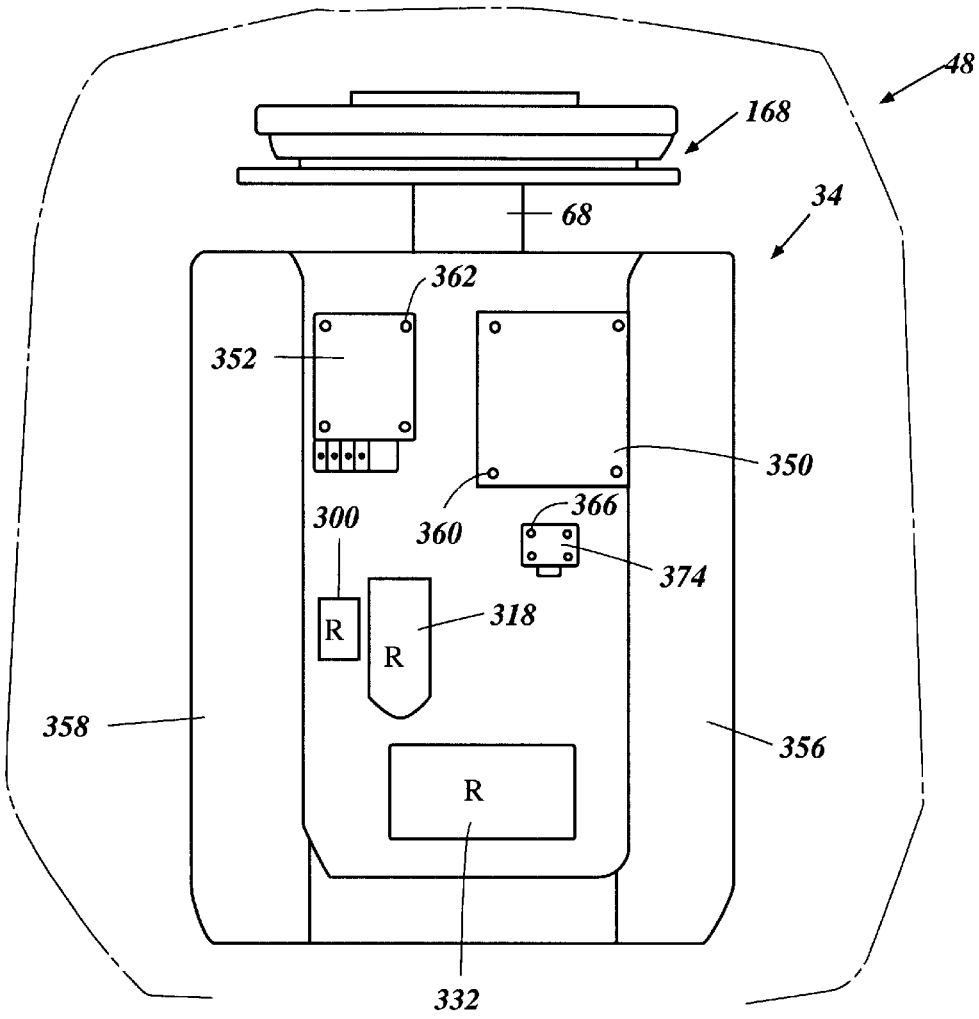
FIG. 5 is a perspective view showing another arrangement of the first, second and third boxes.

With reference now to FIG. 5, another arrangement of the first, second and third boxes 350 352, 354 is illustrated. In this arrangement, the respective boxes 350, 352, 354 are separated and directly mounted on the cylinder block 56. Connector cables (not shown) connect them together. This arrangement is advantageous not only in reducing the beat transmission between the boxes but also reducing the size of the engine by eliminating the stacking of the boxes. That is, by separating the boxes 350, 352, 354, heat produced and accumulated in the second and third boxes 352; 354 is not transferred to the first box 350. In addition, the separated boxes 350, 352, 354 can be more easily located between the engine body and the inner surface of the protective cowling 54. On the other hand, the connector cables extending between the boxes may occupy part of the space and make slightly more complicated coupling the components together. If so, all or some of the relays 300, 318, 330 can be contained in the second box 352 as another arrangement. A larger second box is necessary in this arrangement.

In addition, the foregoing separation of the first and second control devices 210, 212 results in cost saving. The ECU 214 often is specifically configured for the particular engine with which it is to be used. The CPU 216, however, is more generic in nature and can be adapted to almost every engine specification because the power control itself is not greatly engine specific. Additionally, the control of the hydraulic tilt and turn adjustment system is greatly engine specific. The involvement of the control therefore does not preclude the second control device from being widely used. The manufacturing cost thus can be reduced.

Figure 6:
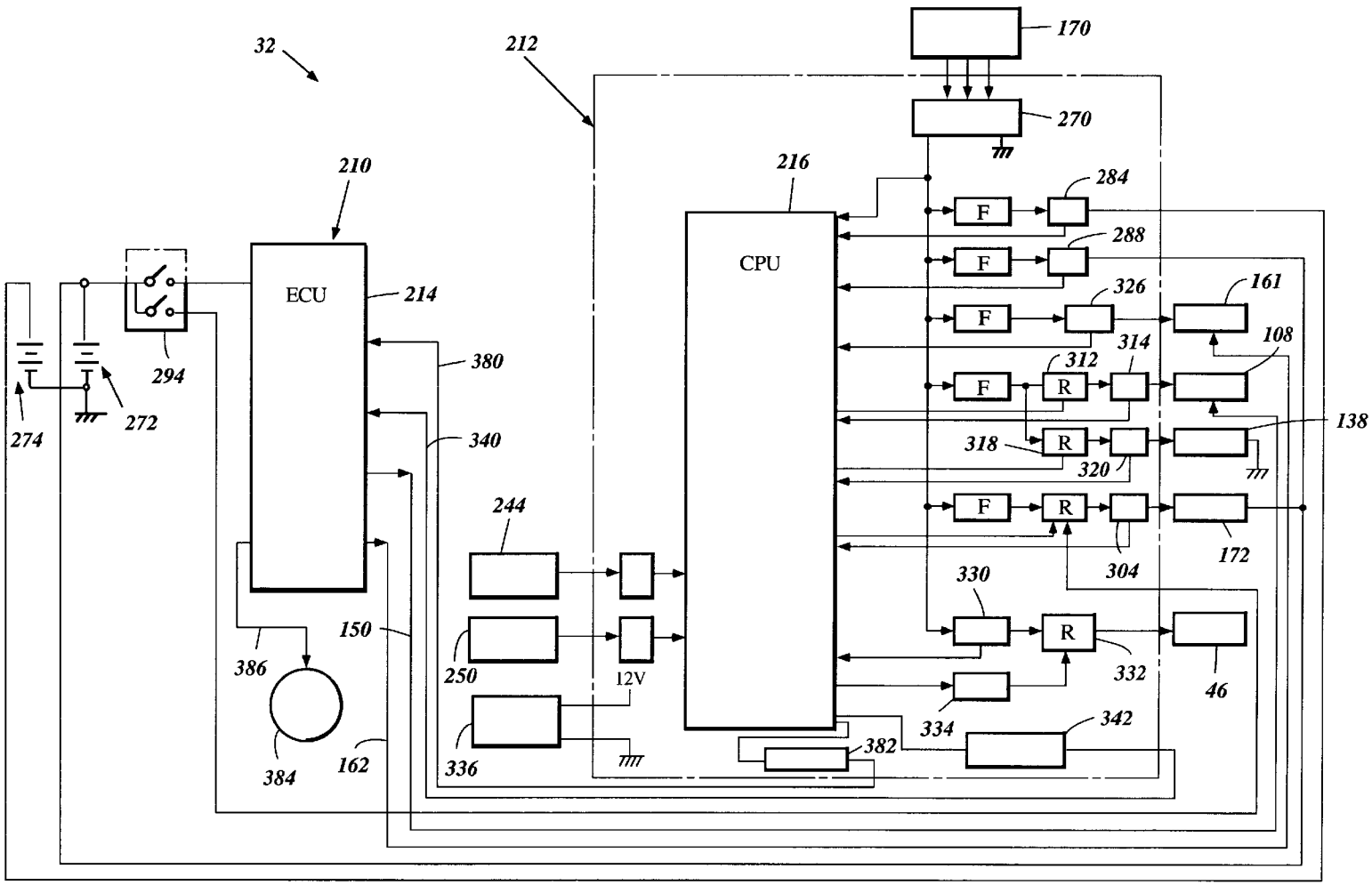
FIGS. 6 is a diagramatical view showing another embodiment of the electrical system.

The hydraulic tilt system preferably uses the power from the battery 272, 274. This is another reason why the tilt system control advantageously is included in the second control device 212. Additionally, the tilt system control can generate electrical noise due to operation of the switching relay 332 and the tilt switch 336. Such noise can adversely affect performance of the ignition system and the fuel injection system. Accordingly, it is preferable that the tilt system control be separated from the ECU 214 that controls the fuel injection system 106 and the ignition system 154. The tilt system control also may separated from the second control device 212 in some configurations With reference now to FIG. 6, a further arrangement having certain features, aspects and advantages of the present invention is illustrated. The same components, units and elements are assigned with the same reference numerals as those in the first embodiment and will not be described repeatedly. In this arrangement, the second control device includes a data line 380 that connects the CPU 216 with the ECU 214 and a trim sensor data output circuit 382 that is positioned within the data line 380. The angular position data sensed by the trim sensor 244 is sent to the ECU 214 from the CPU 216 trough the data line 380.

An indicator 384 can be provided in his arrangement and can be coupled with the ECU 214 through an indication signal line 386. The indicator 384 can be used at least for indicating the angular position data so that the operator can adjust the trim positions to meet the positions which operator desires. The ECU 214 preferably sends an indication signal through the signal line 386 to the indicator 384 and then the indicator 384 indicates the angular positions thereon. The indicator 384 can also indicate the abnormal conditions in the power supply and additionally can indicate other data such as various engine running conditions and/or tilt positions. A warning buzzer can be additionally provided for warning the abnormal conditions.

Figure 7:
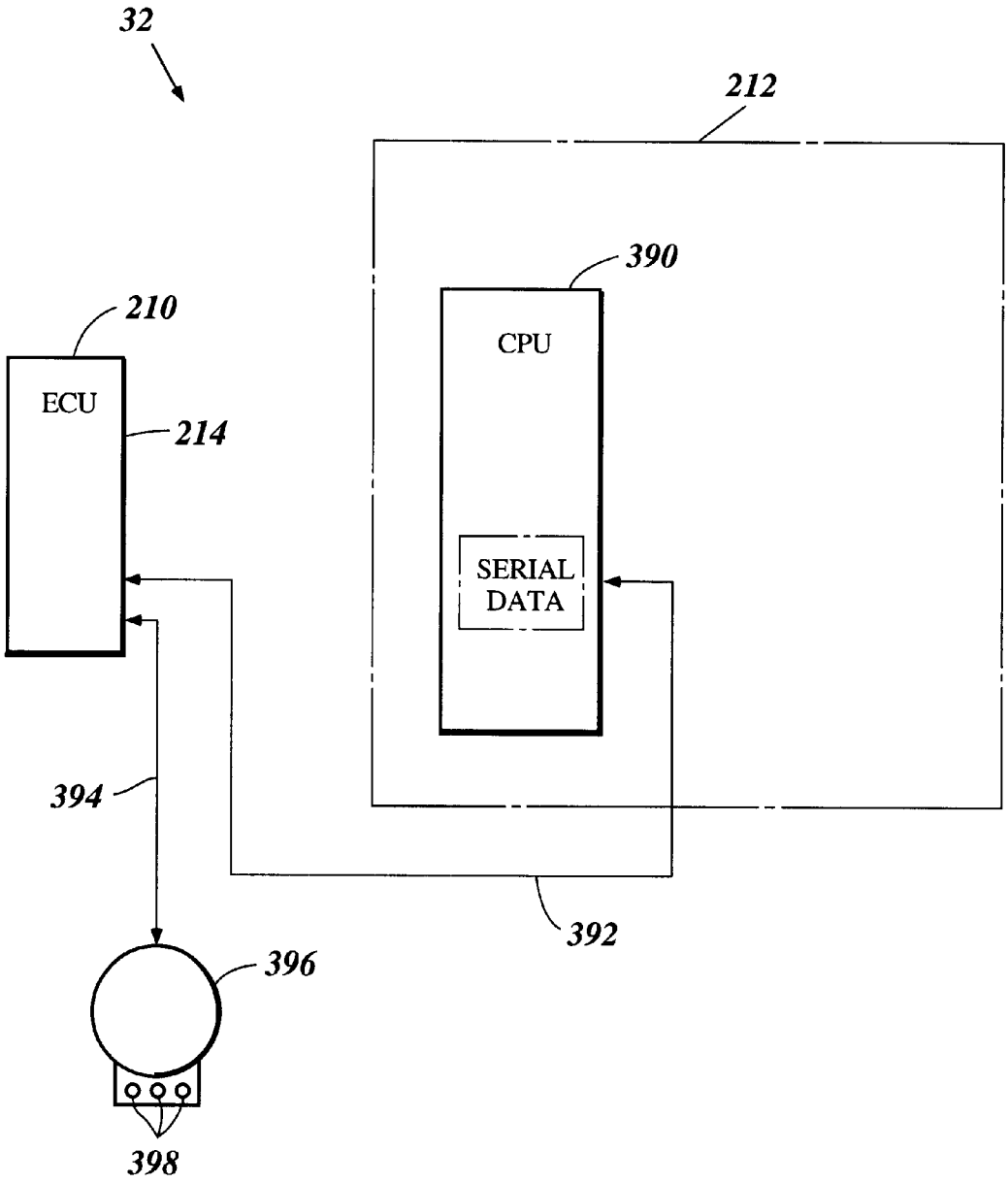
FIG. 7 is a diagramatical view showing a farther embodiment of the electrical system.

With reference now to FIG. 7, another arrangement having certain features, aspects and advantages of the present invention is illustrated. This figure is simplified, but the electrical system 32 is almost the same as shown in FIG. 2 except for portions that are specifically described below.

The first control device 210 in this arrangement has the same ECU 214 as that used in the arrangements described above. The second control device 212 preferably has a CPU 390 that is similar to the CPU 216 that is used in the arrangements described above. The CPU 390 in this arrangement preferably stores a program that can process serial data. The data signal line 380, the indication line 386 and the indicator 384 in the arrangements described above can be replaced with a serial data line 392, serial data indication line 394 and an operation device 396, respectively, in the arrangement of FIG. 7. The operation device 396, however, can still provide the same indication function as noted above. The operation device 396 preferably has input or selection buttons 398 whereby the operator can select an engine mode and/or a trim position. Both the serial data line 392 and the serial data indication line 394 preferably are bilateral and common communication lines. In this arrangement, the ECU 214 stores standard angular position data and the operator can adjust or renew this standard data with the current data sent from the CPU 216. The ECU 214 thus controls the trim adjustment at least in part.

The operator inputs his or her favorite engine mode such as a moderate mode or an aggressive mode. By selecting one of the engine modes, the ECU 214 controls at least the injection timing and duration of the fuel injection system 106 and the ignition timing of the ignition system 154 so as to meet the operator's selection. The operator also selects a proper trim limit position or angular limit position by one of the input buttons 398. In accordance with this limit position selection, the ECU 214 instructs the CPU 390 to stop the electric tilt motor 46 when the trim sensor 244 senses that the drive unit 36 reaches the trim limit position so that the drive unit 36 is not raised beyond the trim limit position.

The first and second control devices can be placed at any desired location in the space between the engine and the inner surface of the protective cowling. The relays and the fuses can be positioned either internally or outside the second box. Also, in some arrangements, one or more of the relays and fuses can be disposed within the third box, another box or independent of any of the above-discussed boxes.

Of course, the foregoing description is that of preferred embodiments of the present invention, and various changes and modifications may be made without departing from the spirit and scope of the invention, as defined by the appended claims.

What is claimed is:

1. An internal combustion engine comprising a combustion chamber, a fuel supply unit arranged to supply fuel to the combustion chamber, and an igniting unit arranged to fire the fuel in the combustion chamber, an electrical system in communication with the igniting unit and the fuel supply unit, the electrical system comprising a power source arranged to supply electricity to the fuel supply unit and the igniting unit, a first control device arranged to control the fuel supply unit and the igniting unit and a second control device arranged to sense a supply of electricity, the second control device being physically separated from the first control device and the second control device being in electrical communication with the first control device.

2. The engine as set forth in claim 1, wherein the fuel supply unit includes a fuel injector disposed within an induction system, and a spray timing and duration of the fuel injector is controlled by the first control device.

3. The engine as set forth in claim 1, wherein the igniting unit includes a spark plug adapted to ignite the fuel within the combustion chamber, and ignition being controlled by the first control device.

4. The engine as set forth in claim 1, wherein the power source includes a generator driven by the engine.

5. The engine as set forth in claim 1, wherein the second control device senses at least one of current and voltage of the electricity.

6. The engine as set forth in claim 1 additionally comprising a first container and a second container, wherein the first container contains the first control device and the second container contains the second control device.

7. The engine as set forth in claim 6, wherein the first container is mounted on the engine.

8. The engine as set forth in claim 7, wherein the second container is mounted on the first container.

9. The engine as set forth in claim 7, wherein the second container is mounted on the engine.

10. The engine as set forth in claim 6 further comprising at least two cylinders each having an associated combustion chamber, the cylinders being juxtaposed to define two banks of a V-configuration, and the first container being disposed within a valley defined by the two banks.

11. The engine as set forth in claim 6 additionally comprising a third container, wherein the power source includes a power regulator, and the third container contains the power regulator.

12. The engine as set forth in claim 11, wherein the third container is mounted on the second container.

13. The engine as set forth in claim 1, wherein the second control device is coupled with the first control device by a warning signal line through which a warning signal is sent to the first control device from the second control device when the second control device recognizes an abnormal condition of the electricity directed to at least one of the fuel supply unit and the igniting unit.

14. The engine as set forth in claim 13 additionally comprising an indicator coupled with the first control device by an indication signal line through which an indication signal is sent to the indicator from the first control device when the first control device receives the warning signal, and the indicator indicating the abnormal condition of the electricity when the indicator receives the indication signal.

15. The engine as set forth in claim 1, wherein the engine powers a marine drive, the drive includes a drive unit and a bracket assembly adapted to be mounted on a watercraft, the bracket assembly arranged to support the drive unit for pivotal movement about an axis extending generally horizontally, a hydraulic actuator arranged to raise or lower the drive unit, a hydraulic pump arranged to selectively activate the hydraulic actuator in the raising direction or in the lowering direction, and an electric tilt motor arranged to selectively drive the hydraulic pump in either one of the directions, and the second control device further controls an operation of the tilt motor.

16. The engine as set forth in claim 15, wherein the outboard drive further includes an angular position sensor arranged to sense an angular position of the drive unit relative to the bracket assembly, the second control device receives an output of the angular position sensor, the second control device being further coupled with the first control device by a data line through which an angular position signal is sent to the first control device from the second control device.

17. The engine as set forth in claim 16 additionally comprising an indicator coupled with the first control device by an indication signal line through which an indication signal is sent to the indicator from the first control device when the first control device receives the angular position signal, and the indicator indicating the angular position of the drive unit.

18. The engine as set forth in claim 1, wherein the engine further includes a starter motor arranged to start the engine, the starter motor being activated by the electricity, and the second control device further watches a condition of the electricity to the starter motor.

19. An internal combustion engine comprising a cylinder block defining a cylinder bore, a piston reciprocating with he cylinder bore, a cylinder head member closing one end of the cylinder bore and defining a combustion chamber with the cylinder bore and the piston, a fuel injector arranged to supply fuel to the combustion chamber, a spark plug arranged at least partially within the combustion chamber, a first control unit arranged to control the fuel injector and the spark former, a second control unit arranged to sense a condition of a supply of electrical power being provided to the fuel injector and the spark former, the first and second control units being physically separated from each other and the second control unit being in electrical communication with the first control unit.

20. The engine as set forth in claim 19 additionally comprising a first closed box and a second closed box, wherein the first control unit is defined in the first closed box and the second control box is defined in the second closed box.

21. The engine as set forth in claim 19 additionally comprising an electrical line coupling the second control unit together with the first control unit so as to send a warning signal to the first control unit from the second control unit when the second control unit recognizes an abnormal power condition at the fuel injector or the spark former.

22. The engine as set forth in claim 21 further comprising an indicator and a second electrical line coupling the indicator with the first control unit so as to send an indication signal to the indicator from the first control unit when the first control unit receives the warning signal, wherein the indicator indicates the abnormal power condition when the indicator receives the indication signal.

23. A marine drive powered by an internal combustion engine having at least an ignition system, the drive comprising a drive unit, a bracket assembly adapted to be mounted on an associated watercraft, the bracket assembly supporting the drive unit for pivotal movement about a tilt axis extending generally horizontally, an actuator arranged to selectively raise and lower the drive unit relative to the bracket assembly, an electrically operable powering device arranged to power the actuator, a first control unit arranged to control the ignition system, and a second control system arranged to control the powering device, the first and second control units being defined separately from each other.

24. The marine outboard drive as set forth in claim 23 additionally comprising a first closed box and a second closed box, wherein the first control unit is defined in the first closed box and the second control box is defined in the second closed box.

25. The marine outboard drive as set forth in claim 23 additionally comprising a angular position sensor arranged to sense an actual angular position of the drive unit relative to the bracket assembly and the angular position sensor being coupled with the second control unit to send an angular position signal to the second control unit.

26. The marine outboard drive as set forth in claim 25 further comprising an electrical line coupling the second control unit together with the first control unit so as to send the angular position signal to the first control unit from the second control unit.

27. The marine outboard drive as set forth in claim 26 further comprising an indicator and a second electrical line coupling the indicator with the first control unit so as to send an indication signal to the indicator from the first control unit when the first control unit receives the angular position signal, the indicator indicating the angular position when the indicator receives the indication signal.

28. The marine outboard drive as set forth in claim 27, wherein the indicator includes an input mechanism arranged to put an angular limit position, the first and second lines defining two-way lines to send an angular limit position signal to the second control unit through the first control unit, and the second control unit controlling the powering device to stop the powering device when the angular position sensor senses that the drive unit reaches the angular limit position.

* * * * *